US010766130B2

(12) United States Patent
Brennenstuhl et al.

(10) Patent No.: US 10,766,130 B2
(45) **Date of Patent: *Sep. 8, 2020**

(54) SYSTEM FORMED BY AT LEAST ONE HAND-HELD POWER TOOL, AT LEAST ONE FIRST INTERFACE, AND AT LEAST ONE ELECTROTECHNICAL PRODUCT

(71) Applicant: Robert Bosch GmbH, Stuttgart (DE)

(72) Inventors: Jens Brennenstuhl, Albershausen (DE); Heiko Roehm, Stuttgart (DE); Maik Rabe, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 186 days.

This patent is subject to a terminal disclaimer.

(21) Appl. No.: 15/777,953

(22) PCT Filed: Nov. 24, 2016

(86) PCT No.: PCT/EP2016/078660

§ 371 (c)(1),
(2) Date: May 22, 2018

(87) PCT Pub. No.: WO2017/089452

PCT Pub. Date: Jun. 1, 2017

(65) Prior Publication Data

US 2018/0345474 A1 Dec. 6, 2018

(30) Foreign Application Priority Data

Nov. 24, 2015 (DE) ..... 10 2015 223 144
Dec. 4, 2015 (DE) ..... 10 2015 224 365
(Continued)

(51) Int. Cl.
*B25F 5/02* (2006.01)

(52) U.S. Cl.
CPC ..... *B25F 5/02* (2013.01)

(58) Field of Classification Search
CPC ..... B23Q 5/00; B25B 27/0085; B25B 1/08; B25F 5/00; B25D 17/24; B25D 2250/221
(Continued)

(56) References Cited

U.S. PATENT DOCUMENTS

2011/0003504 A1 1/2011 Rejman
2012/0292070 A1 11/2012 Ito et al.
(Continued)

FOREIGN PATENT DOCUMENTS

DE 10 2010 041 278 A1 3/2012
DE 10 2012 105 483 A1 12/2013
(Continued)

OTHER PUBLICATIONS

U.S. Appl. No. 15/776,616.*
(Continued)

*Primary Examiner* — Nathaniel C Chukwurah
(74) *Attorney, Agent, or Firm* — Maginot, Moore & Beck LLP

(57) ABSTRACT

A system includes at least one hand-held power tool and at least one electrotechnical product. The power tool includes a housing with a handle, a drive motor arranged in the housing, and a first interface configured to receive information from at least one second external interface and/or to transmit information to the at least one second external interface. The housing of the hand-held power tool and a housing of the electrotechnical product each have a receiving opening. The first interface is removably arranged in a selected one of the receiving openings. The receiving openings are releasably sealed by corresponding covers. The covers close the housings to the outside.

20 Claims, 6 Drawing Sheets

(30) Foreign Application Priority Data

May 11, 2016 (DE) ..... 10 2016 208 106
May 27, 2016 (DE) ..... 10 2016 209 253

(58) Field of Classification Search
USPC ..... 173/2, 4, 176, 181; 227/10; 702/22, 41
See application file for complete search history.

(56) References Cited

U.S. PATENT DOCUMENTS

| | | | |
|---|---|---|---|
| 2014/0159662 | A1 | 6/2014 | Furui et al. |
| 2014/0326477 | A1 | 11/2014 | Thorson et al. |

FOREIGN PATENT DOCUMENTS

| | | | |
|---|---|---|---|
| DE | 10 2012 210 009 | A1 | 12/2013 |
| EP | 2 072 192 | A1 | 6/2009 |
| EP | 2 628 427 | A2 | 8/2013 |
| EP | 2 680 093 | A2 | 1/2014 |
| WO | 2007/058596 | A1 | 5/2007 |
| WO | 2015/061370 | A1 | 4/2015 |

OTHER PUBLICATIONS

International Search Report corresponding to PCT Application No. PCT/EP2016/078660, dated Apr. 5, 2017 (German and English language document) (9 pages).

* cited by examiner

SYSTEM FORMED BY AT LEAST ONE HAND-HELD POWER TOOL, AT LEAST ONE FIRST INTERFACE, AND AT LEAST ONE ELECTROTECHNICAL PRODUCT

This application is a 35 U.S.C. § 371 National Stage Application of PCT/EP2016/078660, filed on Nov. 24, 2016, which claims the benefit of priority to Serial No. 10 2015 223 144.5, filed on Nov. 24, 2015 in Germany, Serial No. 10 2015 224 365.6, filed on Dec. 4, 2015 in Germany, Serial No. 10 2016 208 106.3, filed on May 11, 2016 in Germany, and Serial No. 10 2016 209 253.7, filed on May 27, 2016 in Germany the disclosures of which are incorporated herein by reference in their entirety.

BACKGROUND

Electric hand-held power tools are known in principle, and are supplied with electric power via a mains power connection. Alternatively, battery appliances allow a high degree of flexibility in working since, in particular, they are non-dependent on mains electric power. Thus, for example, work can also be conveniently performed outside, such that in many cases the use of battery packs is provided for operation of a hand-held power tool.

Electrotechnical products, in particular non-motorized electrotechnical products such as, for example, a charging device for a battery pack of a hand-held power tool, a construction site radio, a measuring device or a construction site spotlight, are known in principle and are normally supplied with electric power via a mains power connection. Alternatively, battery appliances allow a high degree of flexibility in working since, in particular, they are non-dependent on mains electric power. Thus, for example, work can also be conveniently performed outside, such that in many cases the use of battery packs is provided for operation of electrotechnical products. An electric hand-held power tool in this case differs from an electrotechnical product that is used in the field of professional trades in that, in particular, unlike the hand-held power tool, the electrotechnical product does not have a motor, and is thus non-motorized.

Such battery packs are known in principle, and have rechargeable batteries, normally a plurality of battery cells that are connected in parallel and/or in series. Within this application, a battery pack is thus to be understood to mean a battery pack, preferably composed of a plurality of electrically interconnected battery cells, that can store electrical energy and supplies the energy required for the operation of a hand-held power tool. For example, three series-connected, cylindrical Li-ion cells, each of 3.6 V, for example, may be provided to give a total voltage of 10.8 V.

Known from the prior art are hand-held power tools that use a communication interface in the form of an infrared transmission means for transmitting, for example, data, parameters or the like. This infrared transmission means enables corresponding data to be exchanged between hand-held power tools and an external interface. It is found to be disadvantageous in this case that such infrared transmission means can be used only to a limited extent, since, on the one hand, there may be obstacles, located between the hand-held power tool and the external interface, that prevent transmission, or a movement by the user interrupts the corresponding connection, at least temporarily. In addition, such an infrared connection can only be used for limited ranges. In the case of fixedly integrated infrared transmission means, it is found to be disadvantageous that replacement of the infrared transmission means is often not possible, and/or the replacement process is elaborate and cost-intensive.

In general, products, from the field of professional trades, that have communication interfaces have the disadvantage that the communication interfaces are fixedly built-in, or integrated, as described, for example, in EP 2 680 093 A2. This disadvantage has the effect that each product has to have its own communication interface, which represents a high cost factor and, in the event of a defect of the communication interface, renders replacement either elaborate and cost-intensive or not even possible at all.

SUMMARY

The object of the disclosure is to provide a communication interface that can be used in a flexible manner in differing products from the field of professional trades.

Disclosed according to the disclosure is a system having at least one hand-held power tool, wherein the hand-held power tool has a housing, having a handle, and has a drive motor arranged in the housing, wherein the drive motor is coupled to a tool receiver. The tool receiver is intended to receive, or fasten in a rotationally fixed manner, an insert tool on the hand-held power tool. The insert tool in this case may be, for example, a drill bit for a power drill, a cutting disc for an angle grinder, or a saw blade for a circular saw. The system comprises at least one first interface, wherein the first interface is designed to receive information from at least one second, external interface and/or to send information to at least one second, external interface. The system furthermore comprises at least one electrotechnical product, in particular an electrotechnical product without a drive motor, having a housing. According to the disclosure it is provided that the housing of the hand-held power tool and the housing of the electrotechnical product each have a receiving opening, wherein the first interface can be removably arranged in the receiving openings. In addition, the receiving opening can be releasably sealed by a cover, wherein the cover closes the housing outwardly. In this way, the first interface can be releasably mounted on the hand-held power tool and the electrotechnical product, the receiving opening enabling the first interface, arranged in the housing of the hand-held power tool and of the electrotechnical product, to be replaced in a simple and inexpensive manner. Since the first interface can be mounted in all hand-held power tools and electrotechnical products according to the disclosure, a first interface advantageously suffices to expand all hand-held power tools and electrotechnical products with the functions of the first interface, since the first interface can be mounted as required in the hand-held power tool or electrotechnical product that is to be used. In other words, the first interface is realized so as to be exchangeable between the at least one hand-held power tool and the at least one electrotechnical product of the system.

Advantageously, the hand-held power tool or the electrotechnical product additionally has a control unit inside the housing. The control unit may on the one hand be in contact with the drive motor and/or with the transmission and/or with battery-pack electronics of a battery pack, or with measuring electronics of a measuring device, and on the other hand be in electronic and/or mechanical contact with the first interface, and receive and/or send information from the first interface.

The housing of the hand-held power tool and/or the housing of the electrotechnical product may comprise an interface housing that is realized so as to constitute a single piece with the respective housing. Advantageously, the interface housing realizes the receiving opening directly in the housing wall of the hand-held power tool and/or of the electrotechnical product, and the receiving opening may be realized in the shape of a cup or box, having a circumferential side wall and a base surface. In particular, it is advantageous in this case that a cup-shaped receiving opening has an almost circular opening that additionally stiffens the housing of the hand-held power tool and/or of the electrotechnical product, which housing is in principle weakened by the opening. The interface housing, in particular the base surface of the interface housing, additionally has at least one opening for the through passage of connection elements, for example at least one electrical lead in the direction of other electrical components such as, for example, the control electronics, measurement electronics, and/or the battery-pack electronics. Alternatively or additionally, it is conceivable for such an opening to be realized in the region of the side wall. Advantageously, an electrical connection can thereby be established between the first interface and the electrical components of the hand-held power tool and/or of the electrotechnical product.

Alternatively, the interface housing may be realized so as to constitute two pieces with the housing of the hand-held power tool and/or of the electrotechnical product, and an interface housing, for receiving the interface, may be arranged in the receiving opening. In a particularly preferred embodiment, the interface housing, with the first interface and the cover, realizes a self-contained module that can be releasably inserted inside the receiving opening. In this case, in particular, the cover and the interface housing may be of a single-piece design, alternatively also of a two-piece design, the module being inserted in the receiving opening of the hand-held power tool and/or of the electrotechnical product, and being releasably fastened, for example by a screwed connection between the receiving opening and the interface housing, or by other connection elements. In this way, the entire first interface is realized in a particularly compact manner, and can rapidly and easily be mounted, replaced and/or retrofitted in the hand-held power tool and/or in the electrotechnical product. A replacement and/or a repair can thus be effected in a rapid, simple and inexpensive manner.

The interface housing may be fastened in the housing of the hand-held power tool and/or of the electrotechnical product, or alternatively inserted in the receiving opening, and held in the receiving opening only by means of the cover. Preferably, the first interface is arranged in the receiving opening as far as possible without play, for example by means of a click connection, such that no rattling noises or the like can be produced, and also unintentional release of the first interface during operation is prevented. It is additionally advantageous if the receiving opening, or the interface housing, are realized in such a manner that the first interface can only be inserted in one way, such that incorrect fitting of the contact printed circuit board, or of the first interface, within the receiving opening of the hand-held power tool and/or of the electrotechnical product can be reliably prevented.

Advantageously, the cover is curved in such a manner that it follows the contour of the housing wall and closes in a flush manner with the latter. The cover may be made of various plastic materials such as, for example, polyamide 6, polyamide 66, PC (polycarbonate), ABS (acrylonitrile-butadiene-styrene copolymer), or of a material mix of differing plastics, and/or be reinforced with glass fiber. Preferably, the cover comprises the same material as the housing of the hand-held power tool and/or of the electrotechnical product.

To allow safe but easy access of the receiving opening and the first interface arranged therein, it is advantageous if the cover is releasably locked in a rotatory manner via a screw-type or bayonet closure. Another embodiment is a cover that is mounted such that it can pivot about a pivot axis, and that can be releasably locked in position on the housing, on the side of the cover that is opposite the pivot axis, by latching, screwed connection, clamping or holding. In this way, the possibility of the cover falling off the housing, or of the cover being lost, can be counteracted in an effective manner. The cover may additionally have a slot-type depression, enabling the cover to be easily opened by means of a coin or a screwdriver. The bayonet closure is easily actuated, but nevertheless ensures reliable closure of the receiving opening. Additionally or alternatively, the cover may also be fastened to the housing by means of at least one connection element, in particular by means of at least one screw.

Preferably, the first interface has a radio module; in particular, the first interface is composed of a radio module, the radio module receiving and/or sending a radio signal based on electromagnetic waves, for example a Bluetooth signal, in particular a Bluetooth low-energy signal, a WLAN signal or an NFC signal. The radio module in this case is an electrotechnical component that is used to establish a communication connection via a radio network in a great variety of fields. Thus, radio networks are already being used, for example, for applications in the so-called machine-to-machine (M2M) environment such as, for example, in the field of industrial automation, in motor vehicles, for assisting applications in the field of telematics, or also for remote polling of supply meters such as, for example, electricity, gas or water meters. Generally, the use of a radio module enables data transmission to be effected wirelessly via a radio network, thereby avoiding, in particular, resource requirements for otherwise necessary cabling. It thus becomes possible for data, parameters or the like to be reliably transmitted from and to an external, second interface by means of simple structural resources. As a preferred exemplary embodiment of such a radio module, for example a WLAN module may be used, for example an 868 MHz module or a 915 MHz module. Other types of radio module may likewise be used. The radio network in this case may be a communication network of any wireless communication standard such as, for example, WLAN (Wireless Local Area Network), Bluetooth, GSM (Global System for Mobile Communications), GPRS (General Packet Radio Service) or UMTS (Universal Mobile Telecommunications System). Moreover, particularly in the field of industrial automation, there is increasing use of wireless communication networks of comparatively short range that are specially adapted to the corresponding applications, also referred to as "Wireless Personal Area Networks (WPAN)". Radio networks based on one of the standards IEEE 802.15.4 or WirelessHART may be cited as examples of these.

Advantageously, an active radio module emits a signal every eight seconds. Alternatively, and depending on the energy supply, the signal may also be emitted at shorter, or also longer, intervals. In particular in the case of energy being supplied by a second energy storage device that is assigned to the radio module, or to the first interface, the radio signal may be emitted, for example, every 10, 20 or 30 seconds, whereas, in the case of energy being supplied by the first energy storage device, assigned to the hand-held power tool or the electrotechnical product, the radio module emits a signal, for example, every four seconds, or even every second. The corresponding radio module of the transmission means may be connected, in particular serially, to the drive control, a measuring means for measuring various system variables, or the like. Such system variables are, for example, the motor rotational speed of the drive motor, a torque, a direction of rotation, etc. for the hand-held power tool, a loudness for the construction site radio, a charge state of the battery pack, a light intensity of a construction site spotlight, or a measurement variable of a measuring device.

To enable the first interface to be supplied with sufficient power in a simple manner, it is provided, according to a preferred development of the disclosure, that the radio module, in particular the first interface, is supplied with energy via the electric power supply of the hand-held power tool or of the electrotechnical product. This is achieved by releasably connecting the first interface to the first energy storage device. The first energy storage device in this case is to be understood to mean, in particular, the electric power supply and/or energy storage device of the hand-held power tool and/or of the electrotechnical product. The electric power supply in this case may be effected via a mains power cable.

Alternatively, it is conceivable for the radio module to have a second energy storage device, which is arranged inside the interface housing, the radio module being connected to the first energy storage device and/or to the second energy storage device. Advantageously, the first interface may be composed of the radio module and the second energy storage device. According to the disclosure, it is provided that, in the case of the electric power supply of the hand-held power tool and to the electrotechnical product being present and having sufficient energy, the radio module is supplied with energy via the electric power supply of the hand-held power tool and/or of the electrotechnical product; and in every other case it is supplied via the second energy storage device. In this way, an energy supply to the radio module can be ensured at all times.

It is additionally advantageous if the second energy storage device is connected to the radio module by means of plug-in or touch contacts, and if the first interface additionally has a resilient impingement means in the form of an elastic element, whereby reliable electrical contacting is ensured. It may in principle be provided that an elastic element, for example a spring element, is arranged between the cover and the second energy storage device, or between the base surface of the receiving opening and the second energy storage device, in order to press the second energy storage device against contact connections, provided inside the first interface, when the cover is closed. Advantageously, such a second energy storage device, for example a button battery, is replaceable. According to the disclosure, this can be achieved by opening the cover, such that, through the opening, a user can remove the second energy storage device from the receiving opening and replace it with a full or charged second energy storage device. When the cover has been closed again, the second energy storage device is held securely inside the receiving opening. In this way, replacement of the entire first interface, together with the radio module, is avoided, and long-term reliable operation of the first interface is ensured in a simple manner.

Alternatively, the second energy storage device may also be realized so as to be rechargeable, the second energy storage device being electrically connected, or able to be electrically connected, to the energy supply of the hand-held power tool and/or of the electrotechnical product in order ensure charging of the second energy storage device. If the hand-held power tool and/or the electrotechnical product has a second energy storage device in the form of a battery pack or mains-power connector plug, the second energy storage device of the first interface can be recharged by means of the energy provided by the mains electric power grid or the battery pack of the hand-held power tool and/or of the electrotechnical product. Advantageously in this case, provided inside the first interface there is a control unit that, depending on the energy supply of the hand-held power tool and/or of the electrotechnical product, charges the second energy storage device of the first interface and/or enables only the first interface to be supplied with energy, via the energy supply of the hand-held power tool and/or of the electrotechnical product, such that sustained operation of the first interface can be ensured in a simple manner.

It is additionally advantageous if the first interface has at least one contact printed circuit board, the contact printed circuit board in this case electrically connecting the radio module and the control unit of the hand-held power tool and/or of the electrotechnical product to each other, and enabling wired or wireless data exchange. The contact printed circuit board may additionally provide further space for accommodating additional electrical units such as, for example, the control unit mentioned above. With regard to this, the contact printed circuit board has at least one connection element, preferably two connection elements, for example plug-in connectors for plug-in contacts, at least one connecting element ensuring the data exchange and/or the energy supply with or by the control unit of the hand-held power tool and/or of the electrotechnical product, and/or a further connection element ensuring the data exchange and/or the energy supply from the contact printed circuit board to the radio module via a touch contact, for example a SIM card contact.

In an alternative embodiment, the first interface does not have its own contact printed circuit board, the radio module and/or the second energy storage device in this case being directly electrically connected, in a wireless or wired manner, to a contact element on a tool. In a further embodiment, it is also possible for the first interface to be arranged inside the receiving opening without contacting to the hand-held power tool and/or the electrotechnical product, such that the hand-held power tool and/or the electrotechnical product can at least be located by means of the radio module.

Preferably, the first interface furthermore has at least one damping element, in particular a viscoelastic element, which is advantageously realized in the form of a ring, for example as an O-ring or O-web, and which is elastically deformable. The damping element in this case may be realized so as to constitute a single piece with the interface housing, with the receiving opening, with the cover, and/or with the contact printed circuit board, or as a separate component. Preferably, the damping element is arranged between the cover and the contact printed circuit board, or radio module. Alternatively or additionally, the damping element may also be arranged between the contact printed circuit board, or radio module, and the base surface or the side wall of the receiving opening. It is thereby ensured that the first interface, inside the receiving opening and/or inside the interface housing, is securely protected against external influences.

Advantageously, the contact printed circuit board is fastened inside the receiving opening or inside the interface housing by means of latching, in which case the holding force may be provided by the damping element. Accordingly, the receiving opening and/or the interface housing may have a plurality of differing latching elements, by means of which the first interface, or a single component thereof, may be locked in position in the interface housing or inside the receiving opening, and fastened as far as possible without play.

It is additionally possible for alignment elements, for example ribs or webs, by means of which the first interface or the interface housing can be unambiguously arranged, or aligned, inside the receiving opening, to be arranged inside the receiving opening and/or on the first interface or on the interface housing. Incorrect mounting can thus be prevented in a simple manner.

The system according to the disclosure may also be provided in a tool system. Accordingly, a system, together with an external unit having a second interface that, in turn, is designed to receive information from the first interface and/or to send information to the first interface, is additionally provided by the disclosure. According to the disclosure, it may be provided that the external unit is a smartphone, an electronic data processing system.

By a simple design expedient, this system, in particular a tool system, enables data, parameters or the like to be reliably exchanged over greater distances between the electrotechnical product, the hand-held power tool and the external unit, thereby making it possible to facilitate monitoring of the operating modes and/or retrieval of the hand-held power tool and/or of the electrotechnical product. Moreover, a plurality of electrotechnical products can be grouped together by means of an electrotechnical product according to the disclosure or in a system according to the disclosure, and operated jointly by means of the external second interface and the respective radio module. It is particularly advantageous in this case that the electrotechnical products can communicate directly with each other by means of the external, second interface and/or via their radio modules.

A hand-held power tool is to be understood to mean, in general, all hand-held power tools having a tool receiver that can be put into motion, for example into rotation and/or oscillation, and that can be driven by a drive motor, such as, for example, a baton screwdriver, battery-powered drill, percussion drills, multifunction tools and/or drill/driver. Transmission of electrical energy in this context is to be understood to mean, in particular, that the hand-held power tool is supplied with energy via a battery and/or via a electric-power cable connection.

In principle, lithium-ion cells, in particular, may be used as battery cells for a battery pack, since, in the case of lithium-ion cells in particular, it is possible to combine a plurality of battery cells to form battery-cell blocks, in which a plurality of battery cells are connected in a parallel connection.

The electrotechnical product may also be realized as a measuring device, in particular a non-motorized measuring device such as that described, for example, in DE 10 2012 210 009 A1, in the form of a locating device. A measuring device may in general comprise at least one housing, in which the measuring unit is accommodated, and an indicating unit, for example in the form of a display.

The measuring unit in this case may have measuring electronics and measuring elements, which may be realized, for example, to detect objects enclosed in walls, to measure distances, to capture ambient parameters such as the temperature, the air humidity, the brightness, the air composition, etc., and to present these to the user via the indicating unit.

The electrotechnical product may be designed as a portable electrotechnical product, as a hand-held lighting appliance, in particular as a construction-site spotlight, as a construction-site radio, as a measuring device, or as a charging device for a battery pack of a hand-held power tool, and the type of the electrotechnical product and/or the component parts used therein, such as the type of battery pack, the type of lamp fitted, or the like, may be identified by means of the radio module, on the basis of an emitted code.

Further features, application possibilities, advantages and designs of the disclosure are given by the following description of the exemplary embodiments of the disclosure that are represented in the figures. The description, the associated figures and the claims contain numerous features in combination. Persons skilled in the art will also consider these features individually, in particular also the features of differing exemplary embodiments, and combine them to form appropriate further combinations. It is to be noted in this regard that the features represented are merely descriptive in character, and may also be used in combination with features of other further developments described above, and are not intended to limit the disclosure in any manner.

BRIEF DESCRIPTION OF THE DRAWINGS

The disclosure is described in greater detail in the following on the basis of preferred exemplary embodiments. The drawings are schematic, and show.

DETAILED DESCRIPTION

Figure 1:
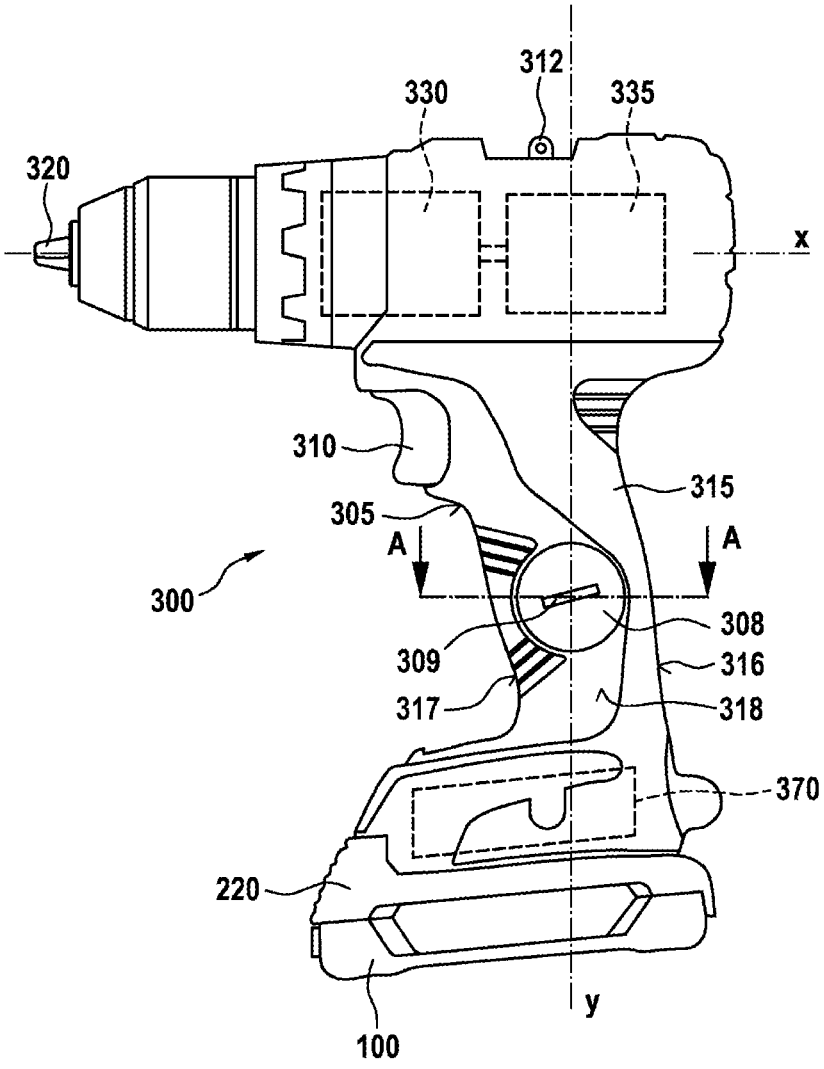
FIG. 1 a side view of a hand-held power tool, with a first embodiment of a first interface inserted in the receiving opening.

FIG. 1 shows an electrical appliance realized as a hand-held power tool 300, which exemplarily is realized as a battery-powered drill/driver. Accordingly, in the embodiment represented, the hand-held power tool 300 is mechanically and electrically connected to a battery pack 100 for the purpose of supplying electric power independently of a mains electric power. It is pointed out, however, that the present disclosure is not limited to battery operated drill/drivers, but rather may be applied in differing hand-held power tools 300 that are operated with a battery pack 100. The hand-held power tool 300 has a transmission 330, which is arranged in a housing 305, and which is not represented, for transmitting a torque generated by a drive motor 335, likewise not represented, to a drive shaft that rotates about a rotation axis x and to which a tool receiver 320 is fastened, and a handle 315. Inside the housing 305 the hand-held power tool 300 has a control unit 370 that is in electronic and/or mechanical contact with the drive motor 335 and the transmission 330. The handle 315 serves as a support surface for a hand of an operator of the hand-held power tool 300, and normally has a longitudinal axis y, a front side 317, which extends along an axis x in the direction of the tool receiver 320, a back side 316, and two side faces 318. The battery pack 100 represented in FIG. 1 is realized as a slide-in battery pack. When the battery pack 100 is placed onto the hand-held power tool 300, receiving means provided on the hand-held power tool 300, e.g. guide grooves and guide ribs, are brought into engagement with corresponding guide elements 110 of the battery pack 100, the battery pack 100 being inserted in a sliding direction along the receiving means of the handle 315, and the battery pack 100 being pushed, along a lower outer surface of the handle 315 that is aligned substantially perpendicularly in relation to the longitudinal direction y of the handle 315, into the battery-pack receiver of a hand-held power tool 300. In the position shown in FIG. 1, the battery pack 100 is fastened to the handle 315 of the hand-held power tool 300, and locked by locking means. The locking means comprise, inter alia, a locking element and an actuating element 220. The battery pack 100 can be released from the handle 315 of the hand-held power tool 300 by actuation of the actuating element 220.

The handle 315 additionally has a receiving opening 307 for receiving a first interface 380. The first interface 380 is designed to receive information and to send this to a control unit 370 arranged inside the housing 305 and/or to a second, external, second interface, not represented. The receiving opening 307 is arranged in a region beneath an operating element 310 for switching the drive motor 335 on and off, or controlling the latter, on one of the two side faces 318. In this way, the operation of the hand-held power tool 300 is not impeded by the arrangement of the receiving opening 307. In the embodiment represented, the receiving opening 307 is realized in the shape of a cup. Alternatively, the receiving opening 307 may also have other embodiments, for example in the shape of a box.

The cup-shaped receiving opening 307 represented has a circumferential side wall 385 and a base surface 381. This has the advantage, in particular, that the almost circular receiving opening 307 additionally stiffens the housing 305 of the hand-held power tool 300, which housing is in principle weakened by the opening 307. The receiving opening 307 can be closed by means of a cover 308. The cover 308 is of a curved design, such that it follows a contour of the housing 305 and closes in a flush manner with the latter. Accordingly, the cover 308 may be made of various plastic materials such as, for example, PA6 (Gebamid B), PA6.6 (Gebamid A), PC (polycarbonate), ABS (acrylonitrile-butadiene-styrene copolymer), or of a material mix of differing plastics, and/or be reinforced with glass fiber, it being advantageous if the cover 308 comprises the same material as the housing 305 and the handle of the hand-held power tool 300.

To allow safe but easy access to the receiving opening 307 and the first interface 380 arranged therein, the cover 308 has a slot-type depression 309. Owing to the slot-type depression 309, the cover 308 can be opened, for example, by means of a coin or a screwdriver. In the case of the embodiments shown in FIGS. 2 and 3, the cover 308 is releasably locked in a rotatory manner, in particular by means of a bayonet closure. As in FIGS. 8 and 9, the cover 308 may also be locked on the housing 305 by means of at least one connection element 306, in particular by means of at least one screw. A further embodiment, not represented, is a hinged cover that is mounted so as to be pivotable about a pivot axis, and that can be releasably locked in position on the housing 305, on the side opposite the pivot axis, by latching, screwed connection, clamping or holding. By means of such a cover 308, the possibility of the cover falling off or being lost can be prevented.

Figure 2:
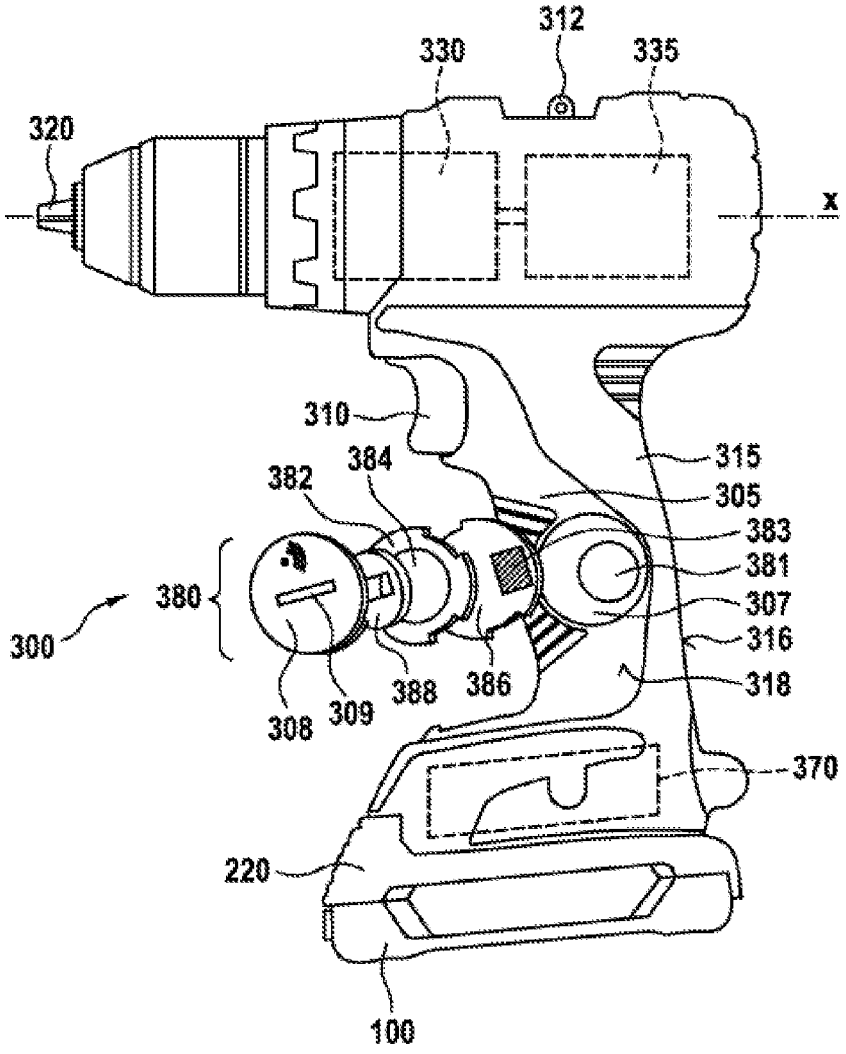
FIG. 2 a perspective view of the hand-held power tool from FIG. 1, with an exploded view of the inserted first interface.

Represented in FIG. 2 is a perspective view of the hand-held power tool 300 from FIG. 1, and in particular a first interface 380 that is releasably inserted in the receiving opening 307 is represented in an exploded view. In the embodiment variant represented, the first interface 380 comprises substantially a damping element 388, a second energy storage device 384, a radio module 382, a contact printed circuit board 386 and also, in the embodiment represented, the cover 308.

Figure 3:
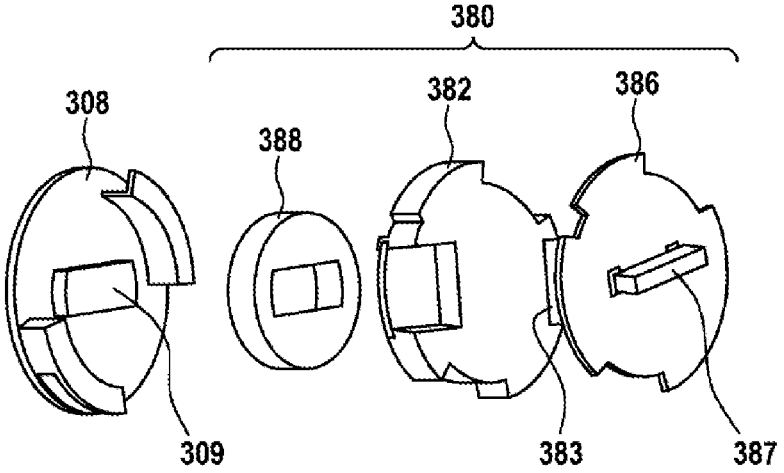
FIG. 3 a detail view of the first interface from FIG. 2.
Figure 4:
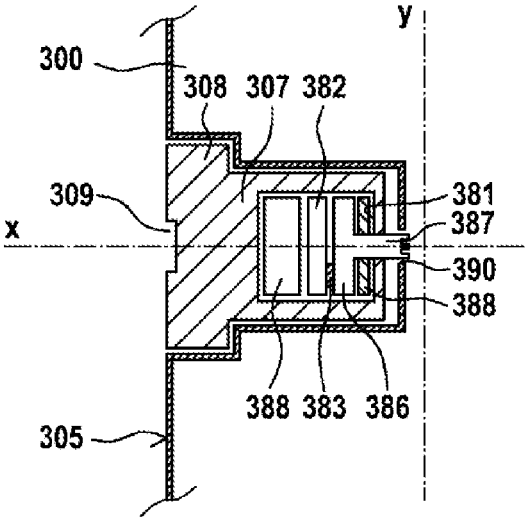
FIG. 4 a sectional view through the receiving opening along the axis y from FIG. 1, with a second embodiment of a first interface inserted in the receiving opening.
Figure 5:
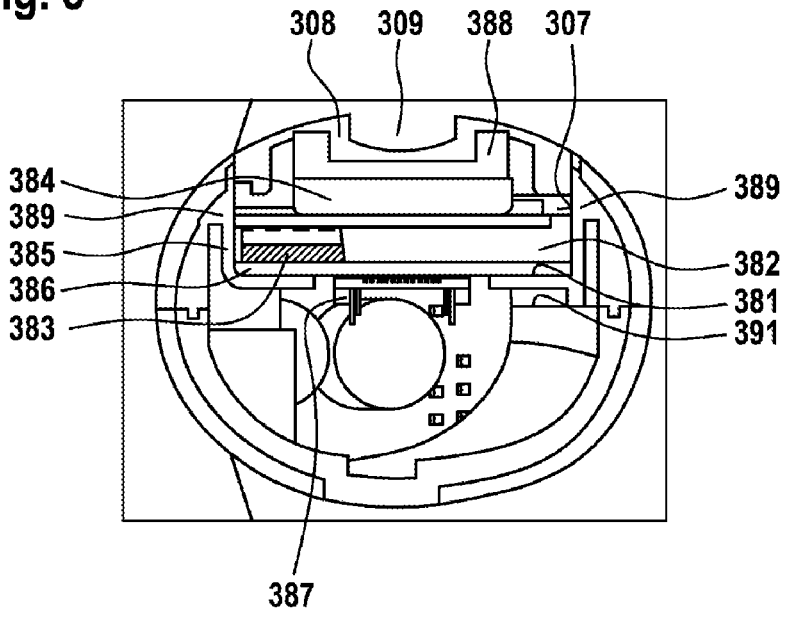
FIG. 5 a sectional view through a receiving opening along the line A-A from FIG. 1, with the first embodiment of a first interface inserted in the receiving opening.
Figure 6:
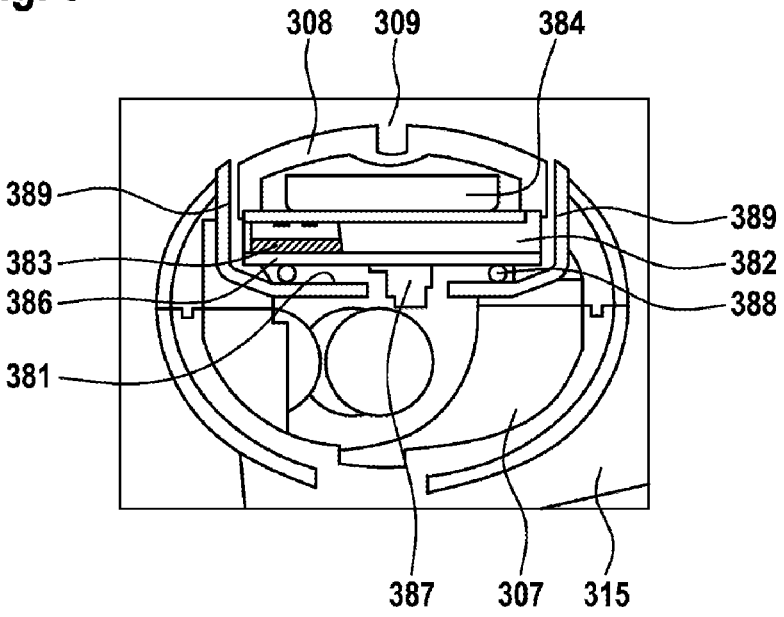
FIG. 6 a sectional view through a receiving opening along the line A-A from FIG. 1, with a third embodiment of a first interface inserted in the receiving opening.

As represented in FIGS. 3 and 5, the receiving opening 307 may realize an interface housing 389 as a single piece with the housing 305. Alternatively, as represented in FIGS. 4 and 6, the interface housing 389 may be realized so as to constitute two pieces and, together with the cover 308, may be releasably inserted, as a module, in the receiving opening 307 of the hand-held power tool 300. The interface housing 389 may be fastened in the housing 305 of the hand-held power tool, or alternatively may also be inserted in the receiving opening 307 and held in the receiving opening 307 merely by means of the cover 308. The first interface 380 is arranged as far as possible without play in the receiving opening 307, for example by means of a click connection, such that rattling noises or the like can be avoided, and unintentional release of the first interface 380 can be prevented.

The interface housing 389 additionally has a base surface 381 having at least one opening 390 for the through passage of connection elements 387, for example at least one electrical lead or a plug-in contact, in the direction of other electrical components such as, for example, the power electronics 370 and/or the battery-pack electronics 800. In principle, alternatively or additionally, but not represented, such an opening 390 may also be realized in the region of the side wall 385.

The first interface 380, and in particular the radio module 382, may be supplied with energy (not represented) by means of a releasable connection of the first interface 380 to the electric power supply and/or to the first energy storage device of the hand-held power tool 300. Alternatively, and as represented in the figures, the first interface 380 has a second energy storage device 384 which, in the embodiment represented, is realized as a button battery and arranged, inside the interface housing 389, directly on the radio module 382 and between the cover 308 and the radio module 382, in its plain of main extent, parallel to the longitudinal axis y of the hand-held power tool 300.

For the purpose of locking the second energy storage device 384 in position, the first interface 380 has at least one elastic element, the elastic element being able to be arranged, for example in the form of a spring element, between the cover 308 and the second energy storage device 384, and/or between a base surface 381 of the interface housing 389 and the contact printed circuit board 386, in order to press the second energy storage device 384 against the contact connections, provided inside the first interface 380, when the cover 308 is closed, whereby reliable electrical contacting can be ensured.

The second energy storage device 384 is replaceable, this being made possible by opening the cover 308. When the cover 308 has been closed, the second energy storage device 384 is held securely inside the receiving opening 307. In this way, replacement of the entire first interface 380, together with the radio module 382, is avoided, and prolonged reliable operation of the first interface 380 is ensured in a simple manner.

Alternatively, the second energy storage device 384 may also be realized so as to be rechargeable, the second energy storage device 384 being electrically connected, or able to be electrically connected, to an energy source, for example to the battery pack 100 or to the mains power connection of the hand-held power tool 300, in order to ensure charging of the second energy storage device 384. Depending on the energy supply of the hand-held power tool 300, the second energy storage device 384 of the first interface 380 is charged, and/or the supply of energy to the first interface 380 is enabled directly via the energy supply of the hand-held power tool 300. In this way, sustained operation of the first interface 380 can be ensured in a simple manner.

In FIG. 3, the first interface 380 from FIG. 2 is represented in detail, and from a different perspective. The radio module 382 is designed to receive and/or send a radio signal, for example a Bluetooth signal, a WLAN signal, an acoustic signal. Accordingly, the radio module 382 is contacted, via a wireless or wired connection, to the control unit 370, the battery-pack electronics 800, and/or various measuring means for measuring tool variables. Such tool variables are, or example, the motor rotational speed of the drive motor, a torque, a direction of rotation, etc. Advantageously, an active radio module 382 emits a signal every ten seconds. Alternatively, however, the signal may also be emitted at shorter intervals, for example every four seconds, or also longer intervals, for example every 20 or 30 seconds.

The contact printed circuit board 386 additionally has electrical units, connection elements 383 such as, for example, a SIM card contact and/or a plug-in connector 387, in order to ensure the exchange of data with the radio module 382 and/or with the control unit 370 of the hand-held power tool 300 and/or the battery-pack electronics 80 of the battery pack 100. In an alternative embodiment, not represented, the first interface 380 does not have its own contact printed circuit board 386, the radio module 382 and/or the second energy storage device 384 in this case being directly electrically connected, in a wireless or wired manner, to a contact element on a tool.

The damping element 388 may be a viscoelastic element, which is advantageously realized in the form of a ring, for example as an O-ring or O-web, and which is elastically deformable. The damping element 388 in this case may be realized so as to constitute a single piece with the interface housing 389, with the receiving opening 307, with the cover 308, and/or with the contact printed circuit board 386, or as a separate component. In the embodiment variant represented in FIGS. 2 to 5, the damping element 388 is arranged between the cover 308 and the radio module 382, or the second energy storage device 384. As represented in FIG. 6 and in detail in FIG. 7, the damping element 388 may additionally also be arranged between the contact printed circuit board 386 and a base surface 381 of the interface housing 389. The damping element 388 ensures that the first interface 380, inside the receiving opening 307 and/or inside the interface housing 389, is securely protected against external influences.

Represented in FIG. 5 is a sectional view through the receiving opening 307, along the line A-A from FIG. 1, the interface housing 389 being realized as a single piece with the housing 305. The receiving opening 307 is of a cup-shaped design, and comprises the side wall 385 and a base surface 381. The first interface 380 from FIG. 3 is inserted in the receiving opening 307, the first interface 380 comprising the cover 308, the damping element 388, the second energy storage device 384, and the radio module 382 and the contact printed circuit board 386. In addition, one of the plug-in connectors 387 projects through the opening 390 in the base surface 381, in order to establish a contact with a contact element, not represented, of the hand-held power tool 300. The receiving opening 307 and the first interface 380 are covered by means of the releasable cover 308. The cover 308 is curved in such a manner that it follows the contour of the housing wall and closes in a flush manner with the latter. In the embodiment variant represented in FIG. 5, the damping element 388 is arranged between the cover 308 and the second energy storage device 384.

Unlike the second embodiment represented in FIG. 5, the third variant represented in FIG. 6 has a sectional view through the receiving opening 307, along the line A-A from FIG. 1, the interface housing 389 being realized so as to constitute two pieces and, together with the cover 308, may be releasably inserted, as a module, in the cup-shaped receiving opening 307 of the hand-held power tool 300. In the embodiment variant represented in FIG. 6, the damping element 388 is arranged between the base surface 381 and the contact printed circuit board 386.

Figure 7:
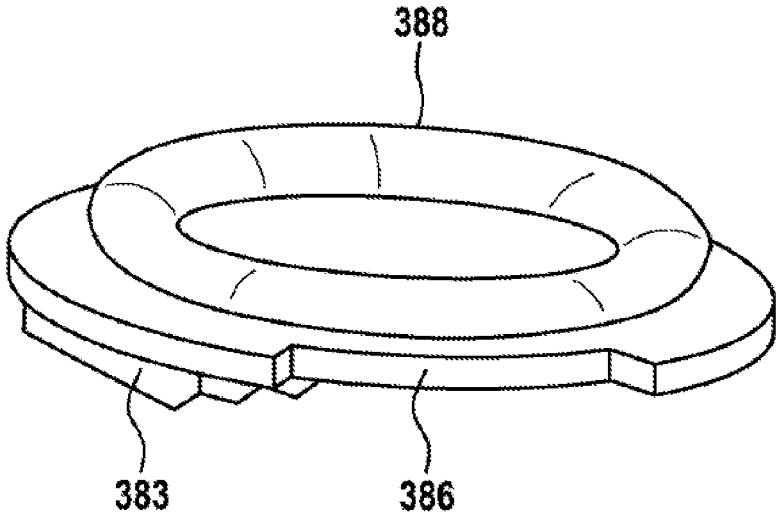
FIG. 7 a perspective view of a contact printed circuit board of a first interface.

In FIG. 7, the contact printed circuit board 386 is represented, together with the damping element 388, in a perspective view. The damping element 388 is designed as a single piece and in the form of a ring, and is attached directly on a first side of the contact printed circuit board 386. A connection element 383 is arranged on a second side of the contact printed circuit board 386.

Figure 8:
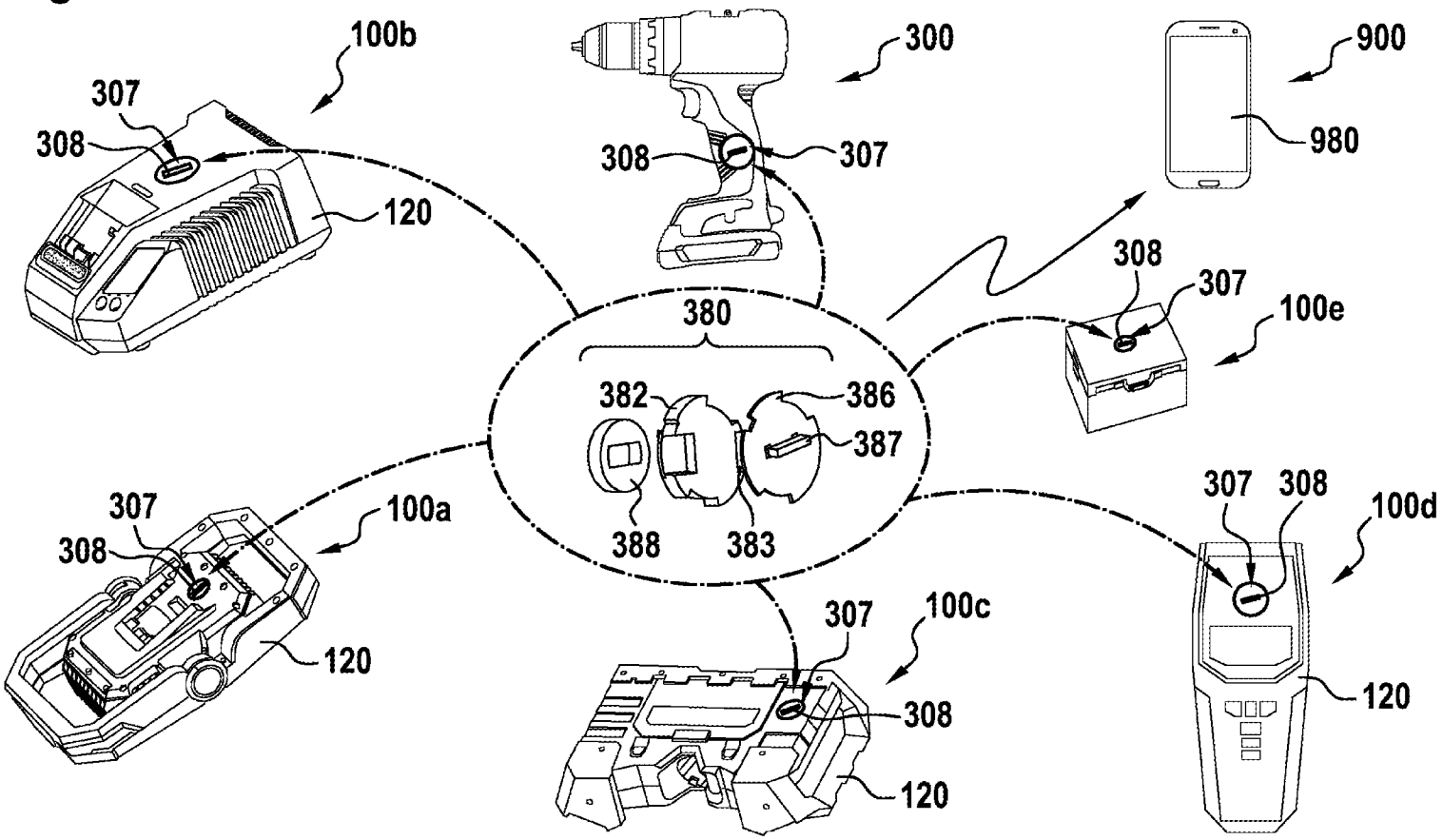
FIG. 8 a perspective view of a system comprising a hand-held power tool, electrotechnical products and a first interface.

Shown in FIG. 8 is a system composed of a hand-held power tool 300, a first interface 380 and an electrotechnical product 100 in the form of a hand-held lighting device 100*a*, a charging device 100*b*, a construction-site radio 100*c* and a measuring device 100*d*. The hand-held power tool 300 and the electrotechnical products in this case each have a cover 308, which covers a receiving opening 307 of the respective housing. The receiving opening 307 is intended to receive the first interface 380 which, according to the embodiment from FIG. 3, is exemplarily realized with a damping element 388, a radio module 382, a contact printed circuit board 386 and connection elements 387. This embodiment in this case is described only exemplarily, and one of the alternative embodiment of the first interface 380, already described in connection with the hand-held power tool 300, is likewise conceivable. As a result of removal of the cover 308, the receiving opening 307 of the hand-held power tool 300 or of one of the electrotechnical products 100*a*, 100*b*, 100*c*, 100*d* is exposed in such a manner that the first interface 380 can be arranged therein, and can be closed again by means of the cover 308. Advantageously, the first interface 380 may be accommodated by an interface housing 389 that is realized substantially identically in the hand-held power tool 300 and the electrotechnical products 100*a*, 100*b*, 100*c*, 100*d*. A single first interface 380 may advantageously be arranged in each hand-held power tool 300 or electrotechnical product 100*a*, 100*b*, 100*c*, 100*d* of the system. Substantially identical, in this context, is to be understood to mean that the first interface 380 can be accommodated in any hand-held power tool 300 of the system and in any electrotechnical product 100*a*, 100*b*, 100*c*, 100*d* in such a manner that at least one electrical connection can be established, in particular via electrical leads, between the first interface 380 of the hand-held power tool 300 and/or one of the electrotechnical products 100*a*, 100*b*, 100*c*, 100*d*. The interface 380 is designed to receive information and to send this to a control unit 370 arranged inside the housing 305 and/or to a second, external interface, not represented. When the first interface 380 is in the inserted state in the receiving opening 307 of the hand-held power tool 300 or in the receiving opening 307 of one of the electrotechnical products 100*a*, 100*b*, 100*c*, 100*d*, for example system variables, commands, data or parameters of the system can be transmitted, via the radio module 382 of the first interface 380, to an external unit 900 having a second interface 980, and/or received. Advantageously, the functional scope of the hand-held power tool 300 or the electrotechnical product 100*a*, 100*b*, 100*c*, 100*d* is thereby expanded. For example, it is conceivable that, when the first interface 380 is in the inserted state in the hand-held power tool 300 or in the electrotechnical product 100*a*, 100*b*, 100*c*, 100*d*, the operating state of the hand-held power tool 300 or of the electrotechnical product 100*a*, 100*b*, 100*c*, 100*d* can be activated or deactivated via the second interface 980.

Also represented is a tool case 100*e*, composed of a housing having a main case body and a case lid, which enclose a tool receiving region. In its case lid, on the outer face, the tool case exemplarily has a receiving opening 307 that has a cover 308, and can thus likewise be expanded with additional functions, which are provided by the first interface 380.

In addition to the embodiments described and illustrated, further embodiments are conceivable, which may comprise further modifications and combinations of features.

The invention claimed is:

1. A system comprising:

at least one hand-held power tool comprising a housing having a handle, a drive motor arranged in the housing and coupled to a tool receiver, and at least one first interface configured to receive information from at least one second external interface and/or to send information to the at least one second external interface; and at least one electrotechnical product comprising another housing, wherein the housing of the at least one hand-held power tool and the housing of the at least one electrotechnical product each have a receiving opening configured to be releasably closed by a cover, and wherein the cover closes the housing of the at least one hand-held power tool outwardly, and wherein the at least one first interface is configured to be removably arranged in the receiving openings.

2. The system as claimed in claim 1, further comprising:

an interface housing configured to receive the at least one first interface and arranged in the receiving opening of the at least one hand-held power tool or arranged in the receiving opening of the at least one electrotechnical product.

3. The system as claimed in claim 2, wherein:

at least one opening, for a through passage of connection elements, is arranged in the interface housing, and the at least one opening is configured to establish an electrical connection between the at least one first interface and electrical components of the at least one hand-held power tool or electrical components of the at least one electrotechnical product.

4. The system as claimed in claim 2, wherein the interface housing is configured to constitute a single piece with the housing of the at least one hand-held power tool or the housing of the at least one electrotechnical product.

5. The system as claimed in claim 2, wherein the interface housing is configured so as to constitute two pieces with the housing of the at least one hand-held power tool or the housing of the at least one electrotechnical product.

6. The system as claimed in claim 2, wherein the interface housing, the at least one first interface, and the cover are configured to form a module configured to be releasably attached in a region of the receiving opening of the housing of the at least one hand-held power tool or the housing of the at least one electrotechnical product.

7. The system as claimed in claim 2, wherein the at least one first interface has a radio module.

8. The system as claimed in claim 7, wherein the at least one first interface has at least one damping element.

9. The system as claimed in claim 8, wherein the damping element is arranged between the cover and the radio module and/or between the at least one first interface and a base surface of the interface housing.

10. The system as claimed in claim 1, wherein the cover has a slot-type depression.

11. The system as claimed in claim 1, wherein the cover is releasably locked on the housing of the at least one hand-held power tool or the housing of the at least one electrotechnical product in a rotatory manner.

12. The system as claimed in claim 1, wherein the at least one first interface has a second energy storage device and/or is supplied with energy via a first energy storage device of the hand-held power tool or of the electrotechnical product.

13. The system as claimed in claim 12, wherein the second energy storage device is replaceable and/or rechargeable.

14. The system as claimed in claim 1, wherein the at least one first interface has at least one contact printed circuit board.

15. The system as claimed in claim 1, wherein the at least one first interface is connected in a wired manner or wirelessly to a control unit and/or to battery-pack electronics of a battery pack to configure the at least one first interface for data exchange with the at least one second external interface.

16. The system as claimed in claim 1, wherein the at least one first interface receives and/or sends a radio signal, a Bluetooth signal, a WLAN signal, an optical signal, or an acoustic signal.

17. The system as claimed in claim 1, wherein the at least one electrotechnical product does not include another drive motor.

18. A tool system comprising:

a system having (i) at least one hand-held power tool including a housing having a handle, a drive motor arranged in the housing and coupled to a tool receiver, and at least one first interface configured to receive information from at least one second external interface and/or to send information to the at least one second external interface, and (ii) at least one electrotechnical product comprising another housing; and an external unit having the at least one second interface configured to receive information from the at least one first interface and/or to send information to the at least one first interface, wherein the housing of the at least one hand-held power tool and the housing of the at least one electrotechnical product each have a receiving opening configured to be releasably closed by a cover, wherein the cover closes the housing of the at least one hand-held power tool outwardly, and wherein the at least one first interface is configured to be removably arranged in the receiving openings.

19. The tool system as claimed in claim 18, wherein the external unit is a smartphone or an electronic data processing system.

20. The tool system as claimed in claim 18, wherein the at least one electrotechnical product does not include another drive motor.

* * * * *